US007214145B2

(12) United States Patent
Park et al.

(10) Patent No.: US 7,214,145 B2
(45) Date of Patent: May 8, 2007

(54) PHOTOCHROMIC GOLF BALL

(75) Inventors: Yang Hwan Park, Seoul (KR); Kyung Jung Kang, Seongnan (KR); Gwang Hee Lee, Seongnam (KR); Jung Gyu Moon, Tigan, OR (US); Chun Bea Ryu, Seoul (KR)

(73) Assignee: Fantom Company, Ltd., Seoul (KR)

( * ) Notice: Subject to any disclaimer, the term of this patent is extended or adjusted under 35 U.S.C. 154(b) by 63 days.

(21) Appl. No.: 10/838,397

(22) Filed: May 4, 2004

(65) Prior Publication Data

US 2004/0266553 A1 Dec. 30, 2004

(30) Foreign Application Priority Data

Jun. 27, 2003 (KR) ..... 10-2003-0042816

(51) Int. Cl.
*A63B 37/00* (2006.01)
*A63B 37/12* (2006.01)

(52) U.S. Cl. ..... 473/378; 473/351; 524/94; 106/31.13; 106/31.15; 106/31.16; 252/582; 252/588; 252/589

(58) Field of Classification Search ..... None
See application file for complete search history.

(56) References Cited

U.S. PATENT DOCUMENTS 4,889,413 A * 12/1989 Ormsby et al. ..... 359/241
5,208,132 A * 5/1993 Kamada et al. ..... 430/138
5,300,325 A * 4/1994 Nealon et al. ..... 427/379
5,989,135 A 11/1999 Welch
6,037,419 A 3/2000 Takesue et al.
6,130,294 A 10/2000 Ichikawa et al.
6,485,377 B1 * 11/2002 Crast et al. ..... 473/351
6,755,912 B2 * 6/2004 Brown et al. ..... 118/500
2001/0027142 A1 * 10/2001 Kennedy et al. ..... 473/604
2003/0109329 A1 6/2003 Kennedy
2003/0212240 A1 * 11/2003 Wu et al. ..... 528/76

FOREIGN PATENT DOCUMENTS

JP 60034469 * 2/1985

OTHER PUBLICATIONS

Camel Chemical, Website Publication, 6 pages, Dec. 29, 2003.

* cited by examiner

*Primary Examiner*—David J. Buttner
(74) *Attorney, Agent, or Firm*—J. Bennett Mullinax, LLC

(57) ABSTRACT

Disclosed is a photochromic golf ball with a one- or multi-piece structure, which comprises a photochromic compound. The photochromic golf ball reversibly changes between two different color states according to exposure to U.V. radiation associated with direct sunlight. The photochromic golf ball is white when it is shielded from direct sunlight, but changes in color when it is directly exposed to direct sunlight. In a golf ball structure having a core, an outer cover, and a transparent coating, the photochromic compound is present either in the outer cover or the transparent coating.

4 Claims, 2 Drawing Sheets

PHOTOCHROMIC GOLF BALL

PRIORITY APPLICATION

This application claims the benefit of the Republic of Korea application having serial number 10-2003-0042801 filed on Jun. 27, 2003, and which is incorporated herein by reference.

BACKGROUND OF THE INVENTION

1. Field of the Invention

The present invention relates to a photochromic golf ball which changes from an initial white color to a different color when exposed to U.V. radiation such as direct sunlight. The present invention is directed more particularly to a photochromic golf ball in which a photochromic pigment is evenly dispersed in a cover layer and/or a transparent coating layer of the golf ball. The golf ball may have a white color when it is shielded from U.V. radiation and undergoes a color change when it is directly exposed to sunlight or other ultraviolet radiation.

2. Description of the Prior Art

Golf is a sport in which a player strikes a small ball with various clubs from a series of starting tees into a series of holes on a course. A player who holes out his ball in the fewest strokes wins. Although golfs place of origin is uncertain, it is believed that Scotland has the longest history. The standard course consists of 9 or 18 consecutively numbered "holes" (the playing areas leading to the cups). The cup measures 4.25 inches in diameter and 4.0 inches or longer in depth and is set into a smooth surface of closely cropped grass, called a green. While playing on a golf course, on average the players walk about 6–7 km over about 4–5 hours.

As golf has been recently popularized as a leisure sport, there is a highly increased demand for golf products, such as golf balls. Most golf balls are traditionally white in color. Occasionally, colored golf balls are used in the winter. Various pigments, such as organic, inorganic, phosphorescent, and fluorescent pigments may be used to provide for a pigmented golf ball. However, other than red or orange based colors used in winter play, pigmented balls are not widely used.

One basic principle underlying the rules of golf is that players must play only their own ball and the ball should not be touched (except to hit it with a club) until the ball reaches the green. Usually, four players play together in a golf game. When all the accompanying players use white golf balls of the same brand, confusion may arise about which golf ball is whose. In this case, each of the players discriminates his own ball from other's with the numerals or logos marked on the golf balls. However, if the markings cannot be seen for various reasons, for example, they are screened by the ground, grass, or other hindrances, the players cannot discriminate the golf balls without moving the golf balls in violation of the rules.

Colored golf balls provide one solution to the problem. That is, if four playing companions use golf balls with four different colors, they can easily discriminate among the golf balls without violating rules of play. From this point of view, there is a need for colored golf balls. However, most golf players prefer white golf balls to other colored ones. Additionally, in order for four companions to play golf with golf balls of different colors, as many as 12 golf balls would be needed according to the golf ball package system in current use (three per color x four colors).

SUMMARY OF THE INVENTION

It is one aspect of at least one of the present embodiments to provide a photochromic golf ball which undergoes a color change in response to U.V. radiation.

It is another object of one of the present embodiments to provide a golf ball which can be easily seen from a great distance following a long drive.

In accordance with the present invention, the above objects of the present invention may be provided by a photochromic golf ball, which reversibly changes between two different color states depending upon exposure to U.V. radiation.

In an embodiment of the present invention, a photochromic golf ball having a one-piece structure or multi piece construction, and comprises a photochromic compound is provided which has a white coloration in the absence of U.V. radiation and which changes color when it is exposed to U.V. radiation such as provided by direct sunlight.

These and other features, aspects, and advantages of the present invention will become better understood with reference to the following description and appended claims.

BRIEF DESCRIPTION OF THE DRAWINGS

A fully and enabling disclosure of the present invention, including the best mode thereof, to one of ordinary skill in the art, is set forth more particularly in the remainder of the specification, including reference to the accompanying drawings.

DETAILED DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

The present invention is directed to a photochromic golf ball which changes color when exposed to U.V. radiation and/or sunlight. The reversible color change occurs by exposure of a photochromic pigment contained within an exterior coating of a golf ball. For instance, the pigment may be added to either a clear primer coat or a top coat finish applied to the exterior of the golf ball or, alternatively, is present within an outer cover layer of the golf ball. The golf ball appears as its original white color in the absence of U.V. radiation or sunlight and shows a different color when exposed to sunlight or U.V. radiation. For example, a golf ball which remains white within an opaque golf bag or container changes its initial color, such as white, into a different color such as blue, violet, red, yellow, orange, etc. When the golf ball is removed from the source of U.V. radiation, the white color is restored.

Figure 1:
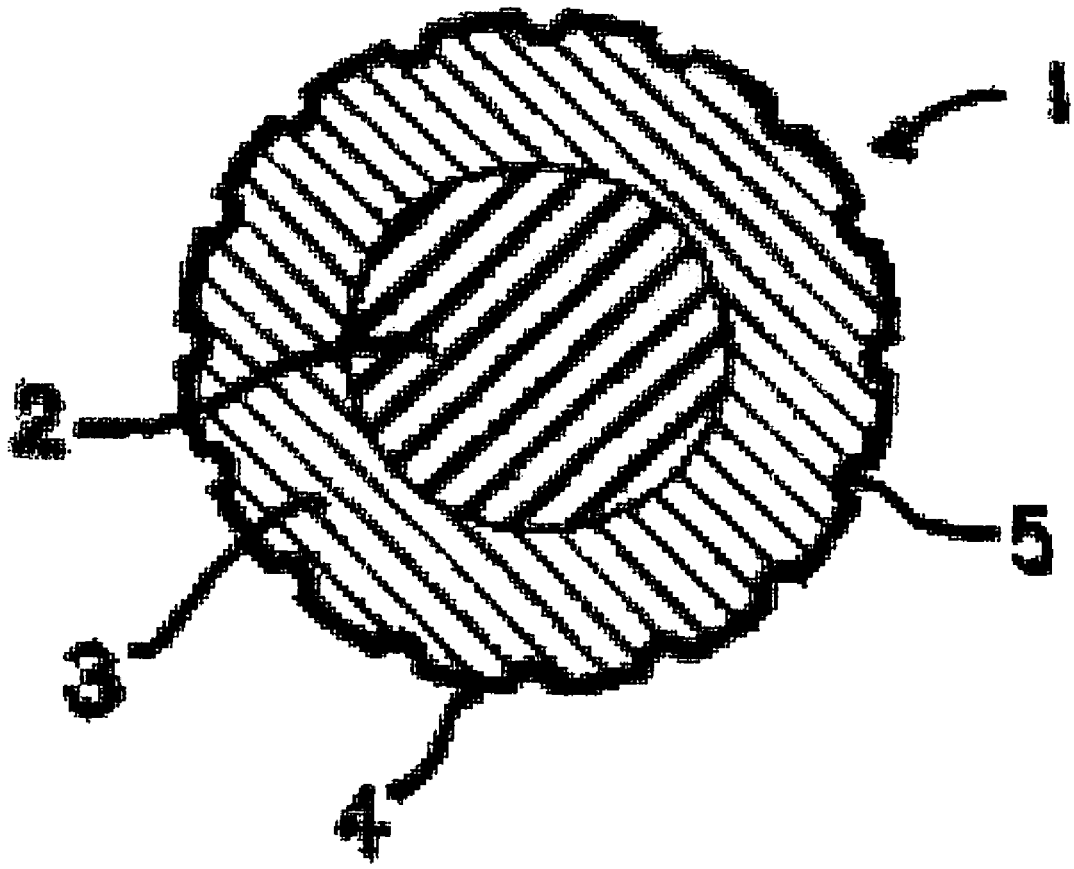
FIG. 1 is a cross-sectional view showing the structure of a 2-piece golf ball in accordance with an embodiment of the present invention.

In the present invention, the photochromic golf ball can be prepared by the inclusion of one or more photochromic compounds into the ball, the photochromic compounds having a color state which varies with exposure to U.V. radiation. The golf ball according to the present invention may have a one-piece structure or multi piece structure. For example, the golf ball of the present invention may be a 2-piece (FIG. 1) or a 3-piece ball (FIG. 2), or a higher-multi piece ball. In such typical golf ball structures, the photochromic compound is contained in a cover layer for 2-piece golf balls, in an outer cover layer for 3-piece golf balls, or in a transparent coating paint for 2-piece, 3-piece, and multi-piece balls. For example, as seen in FIG. 1, the photochromic 2-piece golf ball 1 consists of a core 2, a cover layer 3 with dimples 5, and a transparent coat 4 on the cover layer 3, where a photochromic compound is contained in the cover layer, one of the clear primer coats, or a clear top coat (hereinafter referred to collectively as a transparent coat). In this regard, the photochromic compound is homogeneously mixed with a synthetic resin for golf ball cover, and the mixture is molded into a cover layer for golf balls by injection. Alternatively, the photochromic compound may be homogeneously mixed with either a paint or exterior sealant used to coat the golf balls.

Suitable pigments are those which undergo a color change in response to U.V. radiation and are compatible with the cover or top coat constituents and ball forming processes. Useful pigments have been found to include: spiro(2H-2,3-(3H)naphtha(2,1-b)(1,4)oxazine-1,3-dihydro-1,3,3-trimethyl-6'-(1-piperidinyl)(sold in the trade name of "Photo Chromic Violet", CAS No. 114747-45-4) which turns violet when exposed to U.V. radiation, (1,3-dihydro-1,3,3-trimethyl-6'-(2,3-dihydro-1H-indol-1-yl)spiro(2H-indole-2,8'-(3H)naphtha(2,1-b)(1,4)oxazine (sold in the trade name of Photochrome Blue) which turns blue when exposed to U.V. radiation, and 3,3-diphenyl-3H-naphtho(2,1-b)pyran (sold in the trade name of Photo Chromic Yellow, CAS No. 4222-20-2) which turns yellow when exposed to U.V. radiation. The above photochromic pigments may be obtained from Camel Chemical, Pusan, Korea, along with additional photochromic compounds including red, pink, or orange. Various pigments may also be mixed to choose a desired color hue. Likewise, the amounts of pigments added may be varied to bring about differences in the intensity of the resulting pigment. As such, variations in intensity are perceived as a different color. As a general rule, the photochromic pigments do not exhibit the photochromic properties when in the crystalline state. However, when the photochromic compounds are dissolved in a solvent or in a polymer matrix, the photochromic properties are observed.

The pigments are available in a powder form having a particulate size of between about 20 to about 40 microns. In accordance with the present invention, it has been found that the smaller sized particles are preferred for the purposes of mixing with an ionomer compound or dissolving into a primer coat or clear polyurethane top coat finish.

In the absence of U.V. radiation, the photochromic compounds when dispersed in a solvent or polymer material are colorless. Accordingly, the golf balls having the photochromic compounds will show their original colors, usually white in color, in a shaded environment. The photochromic pigment color change is most intense when exposed to direct sunlight. However, even on cloudy days, there is sufficient U.V. radiation present that an exposed golf ball will undergo a noticeable color change.

While the present invention is disclosed with respect to some specific embodiments set forth below, the photochromic pigment may be applied in at least three different manners. For instance, the pigment may be mixed in with the cover materials so that the cover will undergo the desired color change. When the color change pigment is in the cover, a clear primer coat should be applied to the cover such as conventional water based non-pigmented primers. Following drying, any markings or pad printing which is desired can be done on the primer coated surface followed by coating the primer surface with a clear top coat. Typically, a clear top coat is a solvent based polyurethane coating which, in the present example, would not contain any additional pigments.

Optionally, a cover can be provided having conventional titanium dioxide or other white pigments present. Thereafter, the cover can be coated with a clear primer coat which includes the indicated color change pigment. Following drying, any pad printing can be done on the dried primer coat which is then followed by a clear top coat. In this manner, the top coat helps protect the color change pigment present in the primer coat and does not mask or obscure the color change properties of the resulting golf ball.

Yet an additional option is to provide for a typical pigmented cover for the golf ball and then coating with a primer coat which may include additional white pigments. Thereafter, the cover is pad printed with any markings that are desired and a clear top coat which includes an effective amount of the color change pigment is then applied. In this manner, a golf ball having a conventional white coloration may be provided in which the ball undergoes a color change under the appropriate environmental stimulus.

The golf balls of the present invention can be manufactured by a conventional method. With reference to FIG. 1, there is shown the structure of a photochromic 2-piece golf ball 1 according to an embodiment of the present invention. As shown in FIG. 1, the photochromic 2-piece golf ball has a structure consisting of a core 2, a cover 3 which encloses the core 2 and has a number of dimples 5 thereon, and a transparent coat 4 such as a clear primer and/or a clear top coat layer applied over the cover 3. The core 2 may be made of a synthetic rubber of high resilience. However, any conventional core construction used within the golf ball industry is believed to be compatible with the present invention.

Onto the core 2, the cover 3 is molded from a conventional ionomer resin (e.g., sold in the trade name of Surlyn™ from DuPont U.S.A.) by a well-known technique, for example, injection molding. Suitable ionomer resins and techniques for constructing a cover for a golf ball may be found in reference to U.S. Pat. No. 6,130,294 which is incorporated herein by reference. Suitable multi-piece golf ball covers, techniques, and formulations may be found in reference to U.S. Pat. No. 6,037,419 and which is incorporated herein by reference. The inclusion of the photochromic compounds as further described below is believed to be compatible with any conventional golf ball cover. Accordingly, inclusion of the effective amounts of the photochromic pigments as described herein will impart the color changing properties to the golf ball cover. After being provided with dimples 5, the cover 3 is coated with a primer layer followed by a clear top coat.

Figure 2:
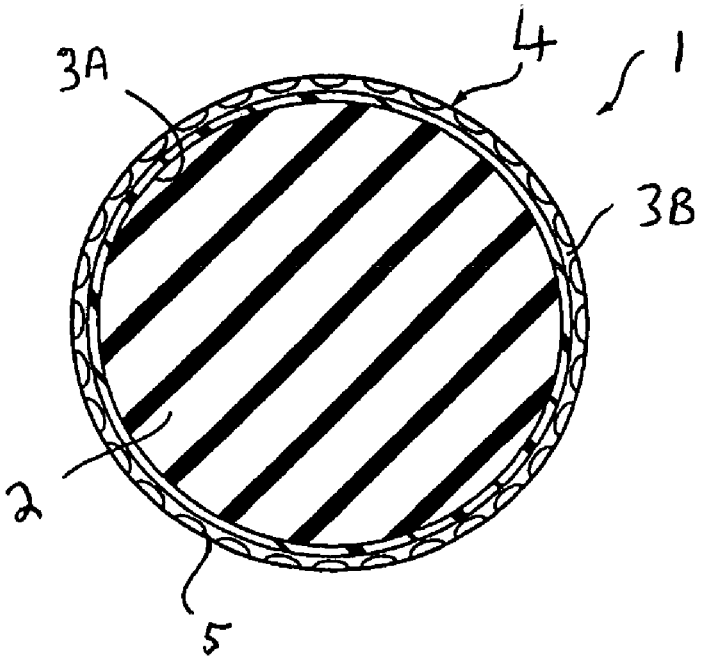
FIG. 2 is a cross-sectional view showing the structure of a multi-piece golf ball in according with an embodiment of the present invention.

As seen in reference to FIG. 2, a 3-piece ball is illustrated having a conventional core 2 having an inner cover layer 3A and outer cover layer 3B. As is conventional in the art, dimples 5 are formed on the outer cover layer 3B and a transparent primer and top coat layer 4 may be applied over the outer cover 3B.

In accordance with the present invention, a photochromic compound is contained in either the cover 3 (or outer cover layer 3B for 3-piece golf ball) or in one of the transparent layers 4 (primer or top coat) applied to cover 3 or outer cover 3B. The cover composition of one or more ionomer resins, together with additives such as dispersants and photochromic compound, are homogeneously mixed. The mixture is injection-molded at a uniform thickness onto the core 2 to form the cover 3.

For a 3-piece ball such as seen in FIG. 2, the respective covers 3A and 3B are separately formed and applied. As is well known and conventional within the art, cover layer 3A is formed and applied to core 2. Thereafter, cover layer 3B is formed and applied to the core 2/cover 3A structure. As discussed further below, the photochromic compound may be mixed in directly with the cover layer 3/3B or incorporated into a transparent coat applied to the cover.

The photochromic compound may be uniformly mixed with a typical transparent primer composition or with a polyurethane resin-based clear top coat composition. The mixture is applied to the cover 3 by conventional techniques such as spraying.

In accordance with the present invention, the cover 3 or one of the transparent layers 4 comprise photochromic compounds in the amount of about 0.1 to about 10.0 parts per hundred, and more preferably in an amount of about 1.0 to about 5.0 parts per hundred, and still more preferably in an amount of about 1.0 to about 3.0 parts per hundred composition. As used herein, the term "parts per hundred cover composition" refers to the ionomer cover composition of either the ball cover 3 or 3B as seen in Table 1. Likewise, "parts per hundred coating" refers to similar units as reflected in Table 2 with respect to one of the transparent coat compositions applied to the golf ball's surface. If needed, various organic solvents such as acetone, ethyl acetate, toluene, hexane, ethanol, di-isobutyl phtalate or tetrahydrofuran (THF) may be used to increase the solubility of the photochromic compounds in a polyurethane, resin-based top coat composition. Additionally, using a water bath to increase the temperature of the photochromic compound and solvents prior to mixing with the clear top coat composition has been found to increase the ease and uniformity of mixing. The use of solvents has been found unnecessary when incorporating the photochromic pigments into the ionomer cover molding compositions.

EXAMPLE

Preparation of Core Ball

A conventional synthetic rubber core composition used in Assignee's commercially available Power Distance™ ball was vulcanized at around 160° C. for 30 min in a typical mold to prepare a core ball for 2-piece golf ball, which measured 38.4 mm in diameter.

Formation of Photochromic Cover

A typical cover resin composition comprising a mixture of Surlyn™ ionomer 8940 in a 50:50 ratio with Surlyn™ ionomer 9910 was mixed with photochromic compounds and additives as shown in Table 1, below, and the resulting mixtures were injected into covers having a thickness of 2.3 mm onto the ball core to provide a 2-piece ball. As is readily appreciated, when the photochromic pigments are to be added into the ionomer, the ionomer mix should not have titanium dioxide or other pigment s present which may mask the visibility of the photochromic pigments. The ionomer 9910 is a clear ionomer which provides for a transparent cover. If desired, a cover made out of 100% 9910 ionomer may be used. When the 9910 ionomer is mixed with an 8940 ionomer, the cover is no longer transparent but remains translucent and provides for the color change pigment to be visualized. After the formation of dimples on the covers, a conventional transparent primer and clear top coat was applied to the covers. The values in the Tables below are expressed in parts per hundred (PPH) relative to the total constituents of the respective cover formulation or top coat formulation.

TABLE 1

| | Examples | | | Comparative |
|---|---|---|---|---|
| Ingredients | 1 | 2 | 3 | Ex. 1 |
| Cover Resin Composition | 100 | 100 | 100 | 100 |
| Photochromic Cpds.[1] | 0.1 | 3 | 5 | — |
| Additives[2] | 1 | 1 | 1 | 1 |

Note
[1]Example 1: Photo Chromic Violet
Example 2: Photo Chromic Blue
Example 3: Photo Chromic Yellow
[2]Additives: Ca lubricant, dispersant, antioxidant, etc., as conventional within the art

Formation of Photochromic Transparent Coat

On the cover prepared with the composition of Comparative Example 1 of Table 1, (minus the photochromic pigments) a conventional polyurethane resin-based, clear top coat paint having the photochromic compounds and additives as shown in Table 2, below, were prepared. The resulting top coat compositions were sprayed to form an applied photochromic transparent coat having a thickness of 0.2 mm.

TABLE 2

| | Examples | | | Comparative |
|---|---|---|---|---|
| Ingredients | 1 | 2 | 3 | Ex. 1 |
| Transparent top coat | 100 | 100 | 100 | 100 |
| Photochromic Cpds.[1] | 0.1 | 3 | 5 | — |
| Additive 1[2] | 1 | 1 | 1 | 1 |
| Additive 2[3] | 1 | 1 | 1 | 1 |

Note
[1]Ex. 5: Photo Chromic Violet
Ex. 6: Photo Chromic Blue
Ex. 7: Photo Chromic Yellow
[2]Curative
[3]Dispersant Upon comparison of golf balls having the color change pigment in the ionomer versus the color change pigment present in one or more of the clear top coat layers, it has been observed that the color change qualities of the ball are maintained longer when the pigments are present in the cover. Where pigments are added only to one or more of the transparent coats, normal wear and tear of the cover layer during play brings about degradation of the pigment and hence regions of the ball which will not undergo the color change. While such characteristics do not affect the overall performance quality of the golf ball, it is believed that consumers prefer the uniform pigment dispersion provided by incorporation of the pigment in the ionomer cover layer.

Color Observation

The golf balls manufactured according to Examples 1 to 6 were observed to be white in color indoors and in shaded areas where direct sunlight was not present. The color changes as shown in Table 3, occurred when the balls were exposed to direct sunlight. For sample balls 1 through 3, the color change occurs in about 20 to about 30 seconds following continuous exposure to UV radiation. In the sample balls in Examples 4 through 6, the pigments located in the primer and/or clear top coat resulting in a more rapid color change upon exposure to UV radiation. For these sample balls, color change occurred in about 10 seconds. Blockage of the direct illumination of the direct sunlight gradually (over a 2 to 5 minute interval) turned the colors back to white. To determine the brightness and saturation of the colors, the golf balls were measured for color coordinates and luminance at the distance of 170 cm by use of a luminance meter (BM-7 manufactured by TOPCON Japan) after being exposed for five minutes to direct sunlight. It was measured that the golf balls of Examples 3 were the strongest and the golf balls of Examples 4 were the palest in color.

TABLE 3

| Golf Balls | Color In Room | Under Sunlight |
|---|---|---|
| Examples 1 & 4 | White | Violet |
| Examples 2 & 5 | White | Blue |
| Examples 3 & 6 | White | Yellow |

Strength Test

1. Method: the golf balls (Example 3 and Comparative Example 2) were repetitively jetted through a one-meter long pipe into a disk 10 cm in diameter (10° loft, groove formed as in iron club). The durability of the golf balls is expressed in terms of number of hits until the golf balls were broken.

2. Result

TABLE 4

| Golf Balls | Hit No. |
|---|---|
| Comparative Ex. 2 (general 2PC) | 130 |
| Example 3 | 130 |

Note:
measured with a durability tester

3. Analysis

As set forth in the comparative examples and test data in the above tables, performance data of a control ball, labeled "FANTOM Power Distance", compared to the various photochromic pigmented golf balls is provided. In Tables 4 and 5, sample balls having 1 PPH of the photochromic pigment in the ionomer cover composition were evaluated. The sample balls having a 2-piece construction were subjected to the durability test as described above along with the performance test data as set forth in Table 5. As indicated, the performance of the balls with respect to performance characteristics and durability is unaffected by inclusion of the pigment into the ionomer cover. While not separately reported, no deterioration of performance results have been observed in balls having the photochromic pigment added to the transparent polyurethane top coat paint.

On the surface of a photochromic golf ball, the color change property can be indicated. For example, numerals or brands, which are usually printed on golf balls, can be printed in the appropriate color. Alternatively, a color coded solid or dotted line may be printed to indicate the color. According to these color identifications, the playing companions can avoid using the golf balls of the same color.

The photochromic golf balls according to the present invention can be packed in the number of three in a box, which may be different in color from each other. Accordingly, even when each of the golf players has only one or two boxes, the golf players can avoid playing with golf balls of the same color.

As described hereinbefore, the golf balls of the present invention may be manufactured to be white in color when in the shade, meeting the color preference of most golf players, while being colored under direct sunlight. The colors disclosed under daylight play allow the players to recognize their own golf ball from a distance, without having to move the ball. Additionally, the bright colors achieved under direct sunlight greatly decreases the number of lost golf balls of the present invention. Further, from the point of teeing up, the golf balls are changed in color, so that all players can identify their companion's golf balls.

An additional advantage of the golf balls of the present invention is the increased visibility of the golf ball while in flight. The nature of the present invention is that a more intense color change occurs on the U.V. light exposed surface of the golf ball. As a result, the lower portion of the ball adjacent either the ground or tee has a much lighter

TABLE 5

| Ball | Carry (Disp/Dist) | Total (Disp/Dist) | Velocity(Ball/Head) | Launch Angle | Back Spin | Trajectory |
|---|---|---|---|---|---|---|
| FANTOM Power Distance (Control) | 5.89/202.33 | 9.63/210.83 | 130.75/91.25 | 11.83 | 2663.83 | 5.85 |
| S/D | 1.44 | 4.26 | 1.06/0.97 | 0.31 | 62.16 | 0.17 |
| Red | 8.42/202.35 | 9.92/211.75 | 131.0/91.5 | 11.98 | 2740.42 | 6.26 |
| S/D | 1.3 | 4.09 | 0.85/1.51 | 0.34 | 89.92 | 0.33 |
| Blue | 6.33/202.17 | 8.82/210.33 | 130.58/91.75 | 11.89 | 2621.17 | 6.18 |
| S/D | 1.7 | 4.05 | 0.67/1.29 | 0.2 | 69.37 | 0.48 |
| Violet | 5/92/201.0 | 7.58/211.25 | 131.92/92.08 | 11.79 | 2791.17 | 6.39 |
| S/D | 1.28 | 4.90 | 0.67/1.24 | 0.25 | 78.72 | 0.35 |
| Yellow | 6.75/200.75 | 8.19/211.67 | 132.25/92.5 | 11.96 | 2785.08 | 5.40 |
| S/D | 2.18 | 5.40 | 0.62/1.00 | 0.24 | 97.21 | 0.32 |

color hue and/or retains the original white coloration. As a result, when the ball is struck by the club, the resulting flight of the ball is more easily observed as the ball's rotation/spin results in a highly visible, contrasting pattern of darker and lighter color tones. The contrast helps increase visibility of the ball during flight as well as during the subsequent roll. Once the ball comes to rest, the sunlight/U.V. radiation will again create a deeper color change on the exposed area of the ball while the lower portion of the ball will take on the original (white) coloration of the ball.

Additionally, the contrast provided between the color change pigment and the shaded (white) portion of the ball is also beneficial during putting. Upon putting the ball, the golfer can track the movement of the ball and observe any spin to determine whether the ball was squarely hit or not. Having this information allows the golfer to note any inconsistencies or poor techniques in his or her putting stroke and to take corrective action.

While the embodiments described above are directed to a uniform dispersion of the photochromic pigments in the outer visible surface(s) of the golf ball the photochromic pigment may also be used in a localized manner with respect to a golf ball. For instance, using a pad printing technique, a localized region or pattern of the photochromic pigments may be applied to a surface of a golf ball. The localized pigments may be in the form of an insignia such as a company logo, sponsorship, or other marking applied to a primer surface of a golf ball. In this manner, when the ball is exposed to U.V. radiation and/or sunlight, the logo of a ball manufacturer, sponsor, or paid advertiser will appear. To the extent the logo or other insignia appears on multiple locations of the ball, such localized patterns would be visible without having to move the ball during play. For example, a traditional white golf ball may be provided which maintains the overall appearance of a white ball. In the described embodiment, only a portion of the ball's outer surface will undergo a color change.

Alternatively, the color change pigment may be applied to either the cover or one of the transparent coats as described above. Thereafter, a logo or other marking can be applied in a black ink outline to the cover or primer coat in which a center portion is applied in white ink. In this manner, the portion of the ball surrounding the logo will undergo a color change while the white ink portion within or defining the logo provides a visible contrast which highlights the logo portion. The black ink applied as an outline or border, further accentuates the demarcation between the color change portion of the golf ball and the logo.

The present invention of the photochromic golf ball may also be used in combination in teachings in Applicant's co-pending application having Ser. No. 10/751,275 having an identical filing date as the current application. The commonly assigned co-pending application entitled "Thermochromic Golf Ball" and which is incorporated herein by reference in its entirety, discloses the use of thermochromic pigments which undergo a color change at a predesignated temperature. By selecting thermochromic pigments which undergo a temperature change around or about 10° C., a golf ball having a thermochromic pigment therein alerts the golfer that a critical point temperature has been achieved. The critical point temperature is one at which performance of the ball due to temperature may be degraded.

Accordingly, it is within the scope of the present invention that one or more aspects of the embodiments of the photochromic golf ball described herein may be combined with one or more aspects of the embodiments seen in reference to the incorporated thermochromic golf ball application. In this manner, it is envisioned that a single golf ball can be provided which has both photochromic and thermochromic properties. In this way, a desirable thermochromic color change may occur. In addition, a portion of the golf ball may be further responsive to a thermochromic pigment to provide a warning or alert when a critical temperature point of the ball is reached.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

What is claimed is:

1. A golf ball comprising:

a core;

an outer cover surrounding said core, said outer cover defining a plurality of dimples;

a transparent top coat applied to an exterior of said outer cover;

a photochromatic pigment which undergoes a color change upon exposure to ultraviolet radiation, said photochromic pigment being present in at least one of said outer cover or said transparent top coat layer; and, an insignia ink printed onto a surface of said golf ball, said insignia further containing therein an effective amount of a second photochromic pigment such that said insignia is visible when said insignia is exposed to ultraviolet radiation.

2. The golf ball according to claim 1 wherein said insignia ink is printed onto a surface of said golf ball, said ink solution containing a concentration of photochromic material of about 0.1 parts per hundred to about 20.0 parts per hundred of the ink composition.

3. The golf ball according to claim 1 wherein said insignia is printed onto a primer layer of said golf ball, said ink solution containing a concentration of photochromic material of about 0.1 parts per hundred to about 20 parts per hundred of the ink composition.

4. The golf ball according to claim 1 wherein said insignia ink is printed onto a surface of said transparent top coat layer of said golf ball, said ink solution containing a concentration of photochromic material of about 0.1 parts per hundred to about 20 parts per hundred of the ink composition.

* * * * *